US009266158B2

(12) United States Patent
Vasi et al.

(10) Patent No.: US 9,266,158 B2
(45) Date of Patent: Feb. 23, 2016

(54) PERFECTED LAYING HEAD

(71) Applicant: DANIELI & C. OFFICINE MECCANICHE SPA, Buttrio (IT)

(72) Inventors: Massimo Vasi, Udine (IT); Luca Crespan, Cervignano del Friuli (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 397 days.

(21) Appl. No.: 13/669,623

(22) Filed: Nov. 6, 2012

(65) Prior Publication Data

US 2013/0112796 A1 May 9, 2013

(30) Foreign Application Priority Data

Nov. 7, 2011 (IT) ..... UD11A0176

(51) Int. Cl.
*B21C 47/10* (2006.01)
*B21C 47/14* (2006.01)

(52) U.S. Cl.
CPC ..... *B21C 47/10* (2013.01); *B21C 47/143* (2013.01)

(58) Field of Classification Search
CPC ..... B21C 47/14; B21C 27/02; B21C 47/10; B21C 47/143; B21C 47/26; B21C 47/262; B21C 47/146
USPC ..... 72/66, 127, 133–135, 146, 147, 274, 72/284, 285, 287, 290, 293, 296, 343, 352, 72/358, 361, 362, 371, 419, 420, 421, 425, 72/426, 428, 142, 143; 242/81, 361
See application file for complete search history.

(56) References Cited

U.S. PATENT DOCUMENTS

| | | | | |
|---|---|---|---|---|
| 3,878,720 | A * | 4/1975 | Stange et al. | 72/310 |
| 4,242,892 | A * | 1/1981 | Wykes et al. | 72/66 |
| 5,312,065 | A * | 5/1994 | Shore et al. | 242/361 |
| 2007/0256752 | A1 * | 11/2007 | De Luca et al. | 72/66 |

FOREIGN PATENT DOCUMENTS

| | | |
|---|---|---|
| EP | 1579929 | 9/2005 |
| JP | 63-295014 | 12/1988 |
| JP | H0287507 U | 7/1990 |
| JP | 2004-042123 | 2/2004 |
| JP | 2005-511317 | 4/2005 |
| WO | 00/44512 | 8/2000 |
| WO | 03/051553 | 6/2003 |
| WO | WO 03/051553 | 6/2003 |
| WO | 2006/111382 | 10/2006 |

* cited by examiner

*Primary Examiner* — Debra Sullivan
(74) *Attorney, Agent, or Firm* — Hamre, Schumann, Mueller & Larson, P.C.

(57) ABSTRACT

A laying head for the production of coils in hot rolling mills comprises a central body provided with a central cylinder and at least a shaped feed pipe, attached to the central body by means of clamping elements and bolts, and at least a circumferential guide disposed on the periphery of the cylindrical element. The circumferential guide consists of a plurality of elementary segments.

4 Claims, 2 Drawing Sheets

PERFECTED LAYING HEAD

FIELD OF THE INVENTION

The present invention concerns a laying head used in suitable coil-forming machines starting from semi-worked metal products, continuous and substantially rectilinear. More specifically, the present invention concerns a laying head in which the helical circumferential channel of the outlet tract is perfected.

BACKGROUND OF THE INVENTION

Coil-forming machines of the known type are disposed at exit from a rolling line rolling metal bars or wire, and are provided with a rotary laying head, comprising at least a shaped pipe that from axial develops until it becomes partly circumferential. The product exiting from the rolling line enters into the pipe with an inlet axis coaxial with the rolling axis, and exits from the pipe with an exit axis tangent to the diameter of the coils to be obtained.

The coils thus formed are disposed by falling onto a roller-type belt, so as to be cooled and sent to the collection and/or stacking zone.

In known machines, at the end of the pipe a helical circumferential exit channel is provided which cooperates with a fixed cylindrical protection in order to stabilize the coils formed and to prevent the leading and tail ends of the rolled product from being deformed. In fact, the balance of forces at work is ensured by the presence of a drawing device. However, when the tail end of the rolled product leaves the drawing device, in particular for small products, that is, from 5 to 12 mm approximately, traveling at speeds comprised between 90 and 120 m/s, an imbalance of the forces is created, since the traction on the rolled product generated by the laying head is no longer balanced by an equal and opposite force acting upstream of the head. This imbalance in the forces determines a violent acceleration of the tail end, which is translated into a over-speed of the material with respect to the peripheral speed of the shaped pipe. Therefore, in the tail end tract of the rolled product, an omega shaped bend or curl would be formed, located on the last coil. The presence of the curl is extremely undesirable since it causes problems of jamming in the operations to collect and stack the coils; it is therefore necessary to manually eliminate the curl.

The shaped pipe and the circumferential channel are subjected to great wear due to the passing of the rolled product inside them, and due to the centrifugal force to which they are subjected.

Therefore, the helical circumferential channel is normally provided removable, both due to problems of wear and also to adapt to the sizes of the rolled product in transit.

Known helical circumferential channels are of various types, including for example those with a free width, those with a controlled width, having a control side, two control sides, with the channel open radially toward the outside, with the channel open toward the axis of rotation, etc.

For example, in WO-A-00/44512, at exit from the shaped pipe a containing ring is provided that extends as far as the exit, comprising a diverging part that accompanies, in a gradual manner, the rolled product exiting from the axial pipe toward the outside, and a terminal part with a constant section, which accompanies the coil to the exit.

In PCT/EP2006/003619 two shaped pipes are provided, which from axial become circumferential, one being offset with respect to the other by 180°.

In U.S. Pat. No. 4,242,892 it is provided that the shaped pipe that from axial becomes circumferential at least partly consists of replaceable elements, made solid with a positioning guide that defines its development as far as the circumferential part, extending for a small angle (about 50°) with a constant radius. The tract with the constant radius is not sufficient to vent the over-speed of the tail end tract and therefore does not guarantee a good conformation of the tail end coils. Moreover, this solution has a certain difficulty in assembly and dis-assembly, also because the seatings of the replaceable elements are integrated with the rotor and therefore the possible change of all the replaceable elements takes a long time. In the laying heads cited by the state of the art the pitch of the helix of the circumferential channel is fixed, and cannot be adapted to different requirements.

In WO 03/051553, which provides the possibility of working rolled products of different sizes, part of the circumferential channel consists of a plurality of guide segments with a channel open toward the outside, peripherally closed by a fixed external cylindrical protection. This solution has the main disadvantage that, in the case of small products, for example with a diameter of less than 12 mm, the size of the channel in which the product is made to pass is much bigger than the size of the product passing through, which causes the head and tail to knock against the external cylindrical protection and therefore defects to the head and tail of the product.

In document JP 2004 042123 A, as in U.S. Pat. No. 4,242,892 mentioned above, part of the shaped pipe consists of replaceable elements, but the replaceable elements, like the elements 30 in FIG. 1 of JP'123, also form part of the helical path of the rolled product, so that the part of the pipe consisting of the replaceable elements has first a growing radius, and only terminally, for an angular extension of less than about 90°, does it have a constant radius. This limited angular extension of the tract with the constant radius entails an insufficient control of the trajectory of the rolled product traveling at very high speed. Moreover, if it becomes necessary (for example to change product) to modify the pitch of the helix, the part connecting the part with the growing radius and the part with the constant radius creates difficulties in assembly and in the correctness of the alignment.

The present invention, compared with the state of the art, sets itself a plurality of purposes.

One purpose of the present invention is to obtain a guide for the rolled product in the last phase of the exit path from the laying head, which prevents or limits the traditional problems of deformation connected to the head and tail of the rolled product, especially for small products, 5-12 mm rolled at high speed, for example 90-120 m/s.

In particular, one purpose is to obtain, at exit from the laying head, a high quality rolled product with the head and tail of the coil perfectly conformed. Another purpose of the present invention is therefore to eliminate the need for the presence of an operator to intervene manually on the positioning of the heads and tails of the coils deposited on the belt, so that they do not create cobbles and therefore stoppages to the rolling process, with the corresponding losses in productivity.

Another purpose is to prevent, in particular for small diameters, the rolled product from repeatedly knocking against the walls of the containing and guide channel, thus deforming and deteriorating the final quality and increasing the wear on said walls.

Another purpose is to obtain a guide for the rolled product on all the sides thereof, as far as the exit.

Another purpose is to guide the rolled product as far as the exit from the laying head and to release the coils formed by it correctly, without creating deformations and stresses.

Another purpose of the invention is to make it easy to replace the whole or part of the guide tract of the rolled product most subject to wear.

Another purpose of the invention is to be able to easily replace the guide of the rolled product when the sizes of the rolled product change.

Another purpose is to be able to vary the value of the pitch of the helix in the terminal part of the guide for the rolled product, depending on the physical and/or technological characteristics of the rolled product.

Another purpose is to make it possible to obtain all the advantages described above also in double pipe laying heads.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a laying head according to the present invention, which overcomes the disadvantages of the state of the art and eliminates the defects present therein, is used for the production of coils, in particular small size products, that is, with diameters of 5-12 mm, preferably 5-7 mm, traveling at speeds of about 90-120 m/s, in hot rolling mills.

The laying head according to the present invention comprises a central body provided with a central cylinder, two flanges being disposed at the ends of the cylinder, and a cylindrical element being associated to a first of the flanges and functioning as a seating for a closed circumferential guide, attached to its periphery. The laying head also comprises a curved feed pipe able to generate the coils, which cooperates with the circumferential guide and suitable to accompany the formed coils toward the outside. The laying head also comprises a support, attached to the other, second flange of the central body, which guides the pipe to the flange. Moreover, the support, connected to the corresponding flange by means of a shaft, is suitable to transmit the rotational motion to the laying head.

According to a first feature of the present invention, the feed pipe, which directs the rolled product in a direction which from axial becomes circumferential, is attached to the central body by means of clamping elements, and is thus replaceable.

The feed pipe, consisting of a closed tube with a substantially spiral shape, defining a progressively growing radius, has an exit end for the rolled product which defines its point of maximum radius.

According to another feature, the closed circumferential guide disposed on the periphery of the cylindrical element comprises a plurality of elementary segments, in which the first of said elementary segments, or segment where the rolled product enters, is disposed directly facing the exit end of the feed pipe, and as an extension thereof.

Each of the elementary segments is conformed with a hole in which the rolled product transits and, in a preferred but non-binding solution, an entrance chamfer. The elementary segments are disposed so as to define, in their entirety, a circumferential guide with a constant radius which accompanies the rolled product to the exit of the laying head. The hole and the entrance chamfer are suitable to accommodate and precisely guide the rolled product exiting from the feed pipe, defining a closed pipe on all sides, guiding the rolled product as far as the exit of the circumferential guide, at which point the desired coil is obtained. The elementary segments are removably attached, and positionable parallel to the axis of the cylindrical element, along the circumference of the cylindrical element itself, using a flange that also functions as an axial guide which is preferably T-shaped. In this way, the individual elementary segment, even under the effect of great centrifugal force, does not come out of its seating.

The presence of a terminal guide pipe, which defines the circular path of the rolled product with its constant radius, with a passage section comparable to that of the rolled product, guarantees an optimum control in a step where the rolled product, being diverted in its path, tends to vibrate and to knock against the walls of the guide pipe. On the other hand, the angular extension of the circular path with its constant radius promotes the stabilization of the rolled product and considerably limits the risk of deformation, in particular of the head and especially the tail segments.

For small size products, that is, comprised between 5 and 12 mm, preferably between 5 and 7 mm, the internal diameter of the hole in the elementary segments is comprised between 12 and 20 mm. This sizing allows to guide the rolled product in an optimum manner, promoting the perfect conformation of the head and tail of the product. Using this sizing, it is no longer necessary to provide an operator who has to adjust the positioning of the heads and tails manually.

The presence of the elementary segments attached to the structure by means of a flange makes it possible to replace or in any case disassemble the feed pipe and/or the circumferential channel, even individually segment by segment, allowing the user to carry out cleaning and maintenance.

Furthermore, the fact that the elementary segments that make up the circumferential guide are removable along the T-shaped axial guide, allows to vary the pitch of the helix of the coil to be made, as a function of the material to be worked. By exploiting the interchangeability of the elementary segments, it is possible to work rolled products with different diameters.

The development of the circumferential guide along the periphery of the cylindrical element preferably occupies an angle of more than 180°, for example comprised between 180° and 360°, thus guaranteeing an optimum control of the formation of the coil even with very small diameters of the rolled product.

According to a variant, the angle covered by the circumferential development is more than 360°.

According to a variant, two feed pipes may be provided, offset by 180° with respect to each other, which cooperate with their own circumferential guides consisting of respective elementary segments. In this case there are two circumferential guides that can be used at successive times, thus doubling the duration of the laying head.

According to another variant, it is possible to have both the two circumferential guides mounted on the same laying head, with different internal diameters and/or pitch so as to adapt to the different rolled products that pass inside them.

According to a variant, the T-shaped axial positioning guide flanges which allow to position the elementary segments parallel to the axis of the cylindrical element, may include holding means, selectively releasable, to hold the elementary segments.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF ONE FORM OF EMBODIMENT

Figure 1:
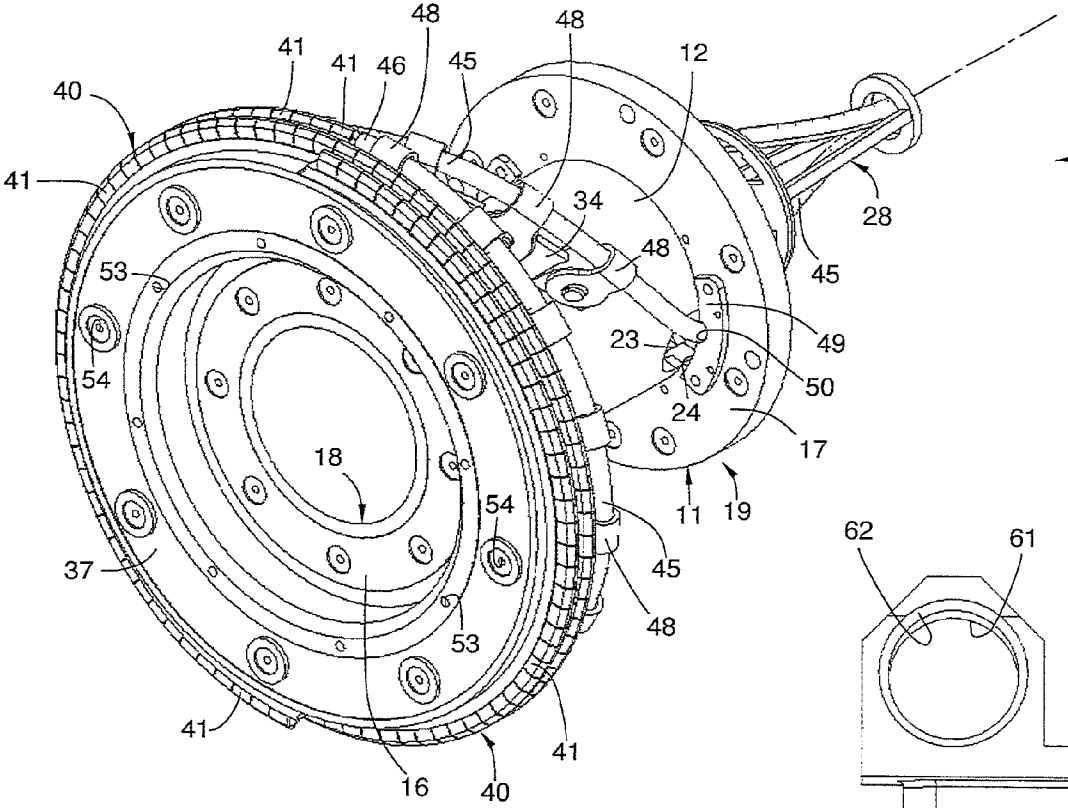
FIG. 1 shows a laying head with two feed pipes according to one form of embodiment of the present invention.

With reference to FIG. 1, a laying head 10 for the production of coils in hot rolling mills comprises a central body 11, consisting of a central cylinder 12, provided with an upper flange 16 and a lower flange 17, disposed respectively at its upper end 18 and lower end 19.

The central cylinder 12 and the lower flange 17 are provided with a respective cavity 23 and 24, communicating with each other and with a semi-circular profile.

The central body 11 is attached in a known manner by the lower end 19 to means, not shown, suitable to transmit the rotational motion to the laying head 10.

The central body 11 is provided with two brackets 34, disposed substantially orthogonal to the surface of the central cylinder 12 and having a helical profile that extends around it. The two brackets 34 are offset by 180° with respect to each other and are suitable to support a feed pipe 45 that determines the passage of a rolled product L from an axial shape when it enters to a substantially helical shape when it exits.

A cylindrical element 37 is attached around the upper flange 16 of the central body 11.

In the case shown in the drawings, two shaped feed pipes 45 are provided, which are disposed inside the support 28, and then pass through the two cavities 23 and 24 of the central body 11. In correspondence with the exit 46, each feed pipe 45 cooperates with the entrance of a corresponding circumferential guide 40, with a constant radius, in particular with the entrance of a first elementary segment 41 of the corresponding circumferential guide 40.

In this way, the rolled product L, already formed with the final diameter of the coil to be formed, is introduced into the corresponding circumferential guide 40, with a constant radius, and accompanied to the exit of the laying head 10, guaranteeing in this way the stabilization of the rolled product L and the reduction in deformation of both head and tail end.

Figure 4:
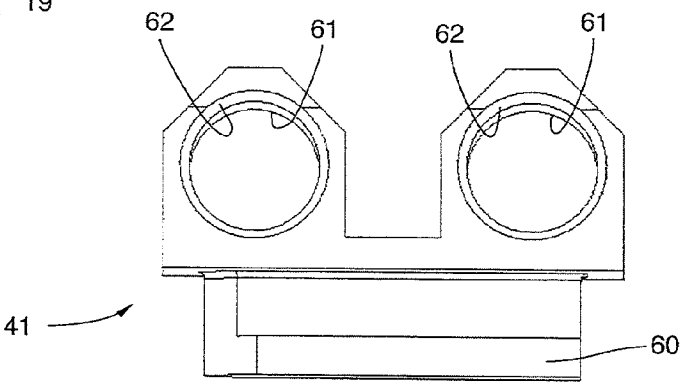
FIG. 4 shows a detail of FIGS. 1, 2 and 3.
Figure 3:
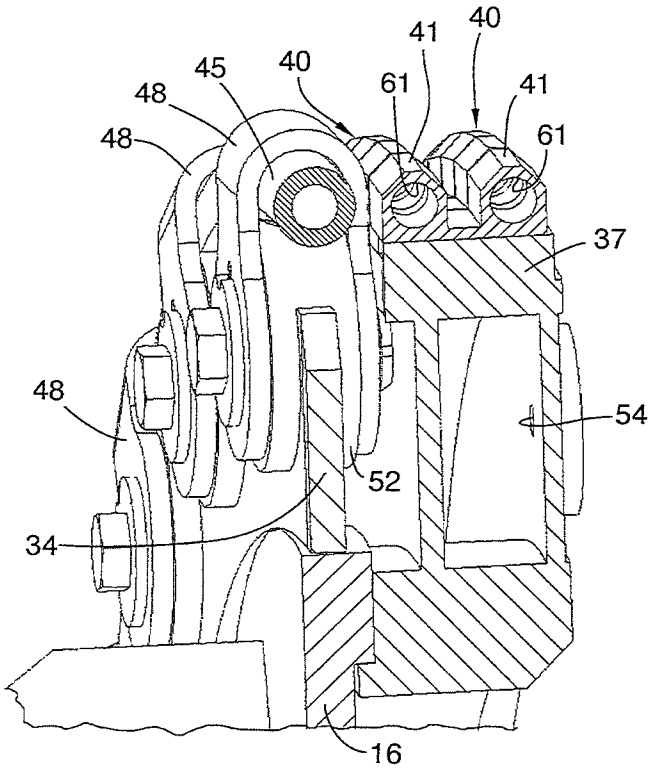
FIG. 3 shows another sectioned portion of the laying head in FIG. 1.
Figure 2:
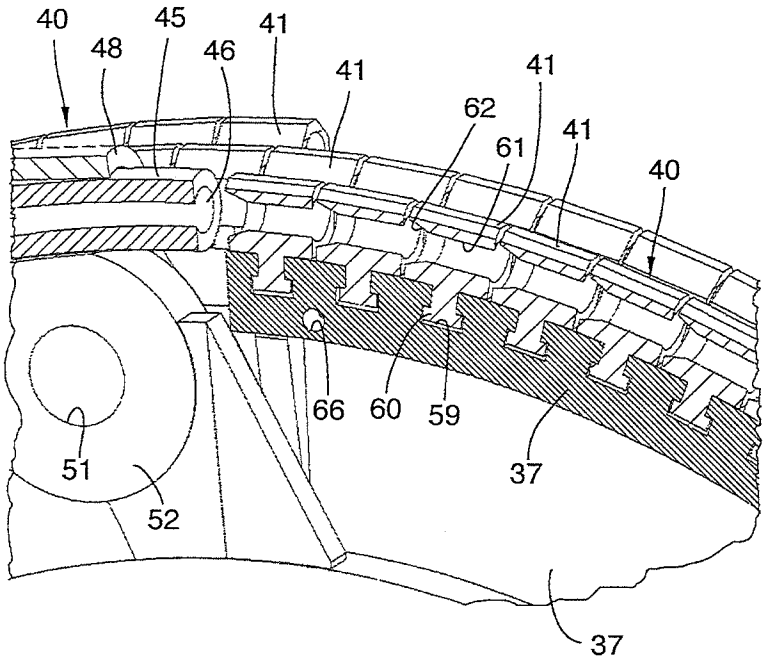
FIG. 2 shows a sectioned portion of the laying head in FIG. 1.

The circumferential guides 40 (FIGS. 2, 3 and 4) are disposed along the whole periphery of the cylindrical element 37, that is, in the case shown here, along an angle equal to 360°. Each circumferential guide 40 consists of a plurality of elementary segments 41, in this case identical to each other and described in more detail hereafter, and develops following a helical development with a constant radius. The two circumferential guides 40 are offset by 180° with respect to each other.

The feed pipes 45 are held in position on the corresponding bracket 34 by clamping elements 48, which are attached in turn to the bracket 34 by bolts suitable to be inserted inside clamping holes 51 made on a protuberance 52. The feed pipes 45 are further held in position by a plate 49, attached on the side of the lower flange 17 facing toward the cylindrical element 37 and provided with a cavity 50, suitably shaped to house the feed pipe 45.

The cylindrical element 37 comprises a series of through attachment holes 53, suitable to contain screws to attach the cylindrical element 37 to the central body 11.

The cylindrical element 37 also comprises a series of balancing holes 54, suitable to promote the balancing of the laying head 10.

The cylindrical element 37 is provided, along its peripheral circumference, with a series of axial guides 59, in this case T-shaped, on which each elementary segment 41 that makes up the circumferential guide 40 can be attached. Each elementary segment 41 comprises an anchoring foot 60, with a profile analogous to that of the corresponding axial guide 59, therefore T-shaped, and suitable to be inserted inside the axial guide 59. Each elementary segment 41 also comprises a hole 61 for the introduction and passage of the rolled product L, and an entrance chamfer 62, which facilitates the conveyance of the rolled product L exiting from one elementary segment 41 toward the following one.

The elementary segments 41 are mounted in a position close-up to each other, so as to constitute a closed guide path for the rolled product L that determines the formation of the coils.

Furthermore, the elementary segments 41 are easily replaceable, by removing the corresponding foot 60 from the T-shaped guide, for reasons of wear or to adapt to different diameters of the rolled product L.

Thanks to the removability of the cylindrical element 37 from the upper flange 16 of the central body 11, if all the elementary segments 41 need to be changed, for example due to wear or to a change in pitch, it is possible to remove the whole cylindrical element 37 containing the elementary segments in a single solution, and replace it by a new one, thus considerably reducing the changeover times.

In the case of a double guide, each elementary segment 41 can be used to define two adjacent transit holes 61 for the corresponding rolled product L.

Peripheral holes 66 are suitable to allow the attachment of holding means to hold the elementary segments.

It is clear that modifications and/or additions of parts may be made to the laying head 10 as described heretofore, without departing from the field and scope of the present invention.

It is also clear that, although the present invention has been described with reference to some specific examples, a person of skill in the art shall certainly be able to achieve many other equivalent forms of laying head, having the characteristics as set forth in the claims and hence all coming within the field of protection defined thereby.

The invention claimed is:

1. A laying head for the production of coils starting from a rolled product, comprising:

a central body including a central cylinder, a flange, and a shaped feed pipe, wherein said shaped feed pipe is attached to said central body by means of clamping elements;

a cylindrical element attached to said flange of said central body; and a circumferential guide disposed on the periphery of said cylindrical element, wherein said circumferential guide consists of a plurality of elementary segments that are disposed adjacent to each other, the plurality of elementary segments define together a guide path closed on all radial and axial sides, and the plurality of elementary segments are configured to include an angular extension having a constant radius of curvature for at least 180°, wherein each of said elementary segments is individually removable and comprises an anchoring foot anchoring to a relative axial guide, said axial guide is T shaped and is conformed to facilitate the removal of the relative elementary segment by means of sliding.

2. The laying head as in claim 1, wherein for rolled products with a diameter comprised between 5 and 12 mm said closed guide path with a constant radius has an internal diameter comprised between 12 and 20 mm.

3. The laying head as in claim 1, wherein said guide path with the constant radius covers an angle of 360° or more.

4. The laying head as in claim 1, wherein each of said elementary segments comprises a hole for the introduction and transit of the rolled product; and an entrance chamfer associated with the hole.

* * * * *